United States Patent [19]

Duba

[11] 4,166,354

[45] Sep. 4, 1979

[54] FREED-FIBER SPINNING DEVICES

[75] Inventor: Fernand Duba, Zillisheim, France

[73] Assignee: Societe Alsacienne de Constructions Mecaniques de Mulhouse, Mulhouse, France

[21] Appl. No.: 839,416

[22] Filed: Oct. 5, 1977

[30] Foreign Application Priority Data

Oct. 14, 1976 [FR] France ..... 76 30872

[51] Int. Cl.[2] ..... D01H 1/12

[52] U.S. Cl. ..... 57/58.89

[58] Field of Search ..... 57/58.89–58.95, 57/77.4

[56] References Cited

U.S. PATENT DOCUMENTS

| | | | |
|---|---|---|---|
| 3,481,128 | 12/1969 | Landwehrkamp et al. | 57/58.89 |
| 3,640,061 | 2/1972 | Landwehrkamp | 57/58.89 |
| 3,778,989 | 12/1973 | Schon | 57/58.89 |
| 3,789,597 | 2/1974 | Schon | 57/58.89 |
| 3,805,505 | 4/1974 | Schuster | 57/58.89 |
| 3,834,147 | 9/1974 | Havranek et al. | 57/58.89 |
| 3,844,100 | 10/1974 | Croasdale et al. | 57/58.89 |
| 3,924,398 | 12/1975 | Esser et al. | 57/58.89 |
| 3,952,494 | 4/1976 | Junek et al. | 57/58.89 |
| 3,965,661 | 6/1976 | Yoshida | 57/77.4 X |

*Primary Examiner*—John Petrakes

*Attorney, Agent, or Firm*—Holman & Stern

[57] ABSTRACT

The device comprises a rotating vacuum chamber and a stationary central tubular yarn-exit component. The component is provided with a first convex annular surface of revolution constituting a bearing plate for the yarn which is being formed and a second surface of revolution constituting a yarn guide tube. The surfaces are joined together by a convex junction surface of revolution and a plurality of air-displacement cavities are provided in the first surface.

3 Claims, 3 Drawing Figures

FREED-FIBER SPINNING DEVICES

This invention relates to devices for freed-fiber spinning (commonly known as open-end spinning). A device of this type comprises a rotating vacuum chamber and a stationary central tubular component for delivering the yarn. This component has a first convex annular surface of revolution constituting a bearing plate for the yarn which is being formed and a second surface of revolution constituting a yarn guide tube, said surfaces being joined together by a convex junction surface of revolution.

One of the difficulties encountered in freed-fiber spinning lies in the need to obtain a yarn having accurate and uniform characteristics. One of these characteristics is that of twist. Since this method has not made it possible up to the present time to manufacture yarns having wholly uniform twist, it has been found necessary to give a higher degree of twist than would actually prove desirable for subsequent use of yarns in order to ensure that those portions of yarn which have a minimum degree of twist are still of sufficient value to permit correct manufacture of the yarn.

The aim of the invention is to produce a freed-fiber spinning device which is not subject to the above-mentioned disadvantage of known devices.

To this end, a spinning device in accordance with the invention is distinguished by the fact that a plurality of air-displacement cavities are hollowed-out in the first surface aforesaid.

By virtue of this particular design concept, the yarn which is being formed is subjected on the bearing plate to the pneumatic action of the air displacement which tends to apply it against said plate with a higher degree of rubbing friction which is conducive to enhanced uniformity of the yarn characteristics and especially of twist. The minimum degree of twist which is compatible with correct manufacture can accordingly be given to the yarn.

A more complete understanding of the invention will be gained from the following description and from the accompanying drawings in which a few embodiments of a spinning device in accordance with the invention are shown by way of example and in which.

Figure 1:
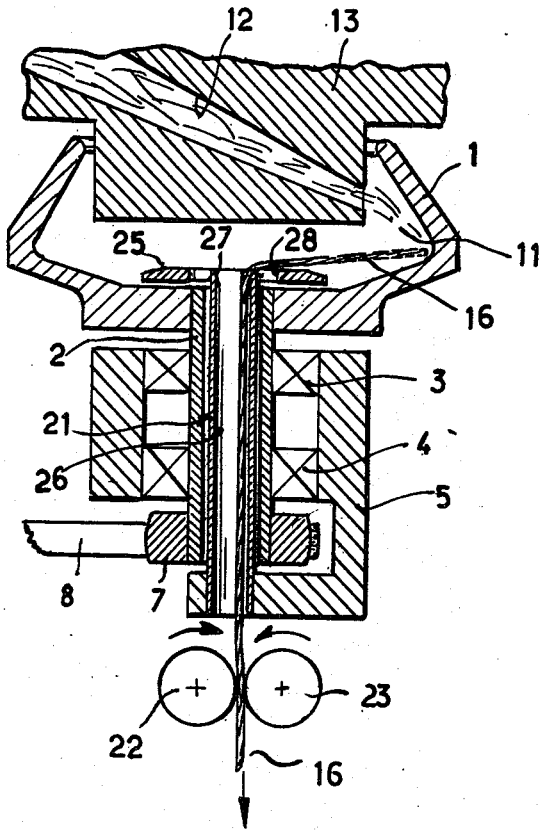
FIG. 1 is a vertical sectional view of a first embodiment as a whole.

The freed-fiber spinning device shown in FIG. 1 is essentially constituted in accordance with a conventional arrangement by a rotating chamber 1 provided with a hub 2 carried by means of two ball-bearings 3, 4 on a stationary support 5. The hub 2 carries a pulley 7 over which passes a belt 8 for driving the rotating chamber 1.

The freed fibers 11 which have passed out of a fiber-opening device of any suitable and conventional type are fed into a duct 12 located at an oblique angle within a fixed cover 13 in order to be projected against the internal face of the rotating chamber 1. The yarn 16 which is formed passes through a stationary central tubular component 21 and is drawn through a pair of rollers 22, 23.

Figure 2:
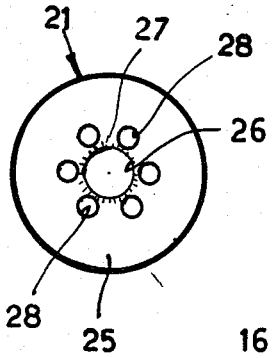
FIG. 2 is a plan view of the stationary central tubular component for delivery of the yarn.

The stationary central tubular yarn-exit component 21 has a first convex annular surface of revolution 25 which forms a bearing plate for the yarn 16 which is being formed and a second surface of revolution 26 which constitutes a yarn guide tube. The first surface 25 is located within the rotating chamber 1 and since a partial vacuum is maintained within said chamber in accordance with a conventional technique, said surface 25 is also under a partial vacuum. A convex junction surface of revolution 27 is formed between the two surfaces 25 and 26 (see also FIG. 2).

Air-displacement cavities are hollowed-out in the first convex annular surface of revolution 25, the bottom of each cavity being pierced by a communication hole which opens into the space between the stationary central tubular component 21 and the rotating portions 1 and 2 of the device. In the embodiment shown in FIG. 1, the air-displacement cavities are cylindrical and the communication holes are also cylindrical, have the same diameter as the cavities and, as shown in the figure, consequently coincide so as to form simple holes 28.

During operation, the freed fibers 11 which are admitted into the rotating chamber 1 give rise to the production of a thread 16 which is guided by the stationary central tubular component 21 and drawn through the rollers 22, 23. At the time of initial formation, the thread 16 is applied against the bearing plate constituted by the first convex annular surface of revolution 25. Since a partial vacuum is maintained within the rotating chamber 1, an upflowing airstream is in fact established within the space formed between the stationary yarn guide tube 26 and the bore of the hub 2 of the rotating chamber. A centrifugal airstream is also established between the internal face of the bottom wall of said chamber and the underface of the annular yarn bearing plate 25 under the combined action of the pressure differences and of the relative movement of rotation of the two faces aforesaid. A downwardly directed airstream is also established through the holes 28 of the yarn bearing plate and has a tendency to displace the yarn, that is to say to apply it against the bearing plate in a more reliable manner and consequently to stabilize its tension. The conditions of formation of the yarn are therefore made more uniform by the presence of the air-displacement cavities, thus making it possible to endow the yarn with more uniform characteristics. All other things being equal, it is therefore possible to give a lower degree of twist to the yarn.

Figure 3:
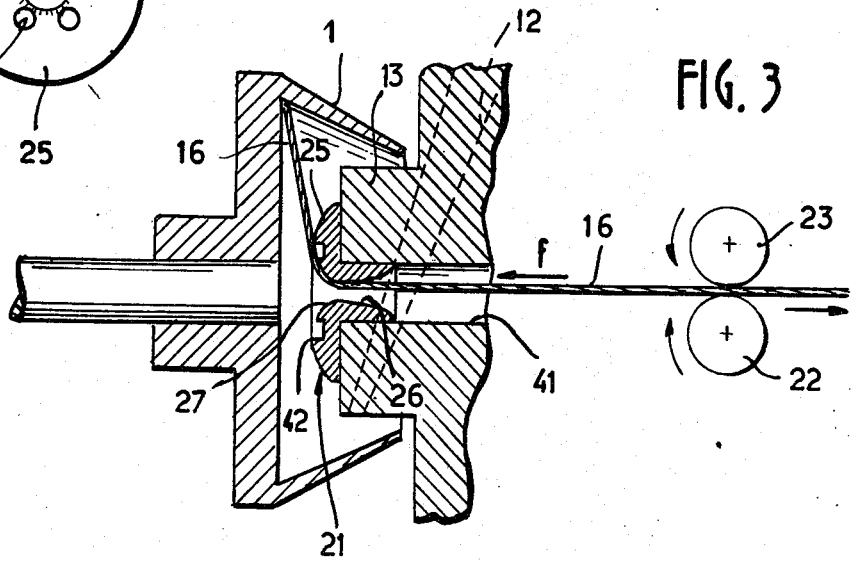
FIG. 3 is a vertical sectional view showing the main portion of a second embodiment.

In the embodiment which has just been described, the formed yarn is delivered through the pierced bottom wall of the rotating chamber but could also be delivered through a central duct 41 formed in the cover 13 as shown in FIG. 3 by way of alternative. In this case, the yarn bearing plate 25 is in contact with the cover 13, with the result that it would serve no useful purpose to pierce a communication hole between the bottom portions of the air-displacement cavities 42 formed in the external surface of said plate and the other face of this latter. Under the action of the partial vacuum which prevails within the rotating chamber 1 and the rapid movement of rotation of this latter, an airstream is produced in the direction of the arrow f within the central duct 41 and the yarn guide tube 26; this airstream spreads out against the junction surface 27 and against the forming plate 25. As it passes in very close proximity to the cavities 42, said airstream produces an effect of turbulence which, in the region of each cavity which is located nearest the axis of the plate, has a tendency to draw the yarn into said cavity and consequently to stabilize its tension. The conditions of operation are similar to those of the embodiment described with reference to FIG. 1 in regard to the design function of the air-displacement cavities.

As can readily be understood, the invention is not limited in any sense to the embodiments hereinbefore described and illustrated in the accompanying drawings. Depending on the applications which are contemplated, many alternative forms within the capacity of anyone versed in the art are accordingly permitted without thereby departing from the scope or the spirit of the invention.

I claim:

1. An open-end spinning device for forming yarn, said device comprising:

a rotating vacuum chamber having an axis of rotation; and a stationary central tubular yarn-exit component including a first convex annular surface of revolution constituting a bearing plate for said yarn, said component including a second surface of revolution means defining a yarn guide tube, said first surface comprising a convex surface of revolution, said first surface including means defining a plurality of cylindrical air-displacement cavities, each of said cavities having an axis parallel to said axis of rotation.

2. An open-end spinning device for forming yarn, said device comprising:

a rotating vacuum chamber having an axis of rotation; and a stationary central tubular yarn-exit component including a first convex annular surface of revolution constituting a bearing plate for said yarn, said component including a second surface of revolution means defining a yarn guide tube, said first surface comprising a convex surface of revolution, said first surface including means defining a plurality of cylindrical air-displacement cavities, each of said cavities having an axis parallel to said axis of rotation, said rotating vacuum chamber includes a tubular component mounted coaxially with respect to said stationary central tubular yarn-exit component, said vacuum chamber tubular component defining a clearance space with said stationary central tubular yarn-exit component, and means for providing communication between said cavities and said clearance space.

3. The apparatus of claim 2 wherein said means for providing communication comprises cylindrical apertures coaxially extending from and having diameters the same as said cavities.

* * * * *